US008387831B2

(12) United States Patent
McInerney

(10) Patent No.: US 8,387,831 B2
(45) Date of Patent: Mar. 5, 2013

(54) UTILITY HYDRATION SYSTEM

(75) Inventor: Joseph Gerard McInerney, Liverpool (GB)

(73) Assignee: Joseph Gerard McInerney, Liverpool, Merseyside (GB)

( * ) Notice: Subject to any disclaimer, the term of this patent is extended or adjusted under 35 U.S.C. 154(b) by 773 days.

(21) Appl. No.: 12/304,625

(22) PCT Filed: Jun. 14, 2007

(86) PCT No.: PCT/GB2007/050337

§ 371 (c)(1), (2), (4) Date: Aug. 20, 2009

(87) PCT Pub. No.: WO2007/144672

PCT Pub. Date: Dec. 21, 2007

(65) Prior Publication Data

US 2010/0001022 A1 Jan. 7, 2010

(30) Foreign Application Priority Data

Jun. 15, 2006 (GB) ..... 0611845.9
Aug. 10, 2006 (GB) ..... 0615926.3

(51) Int. Cl.
*B67D 7/84* (2010.01)

(52) U.S. Cl. ..... 222/175; 224/148.2

(58) Field of Classification Search ..... 222/175, 222/78; 224/217–219, 148.1–148.7; 2/160
See application file for complete search history.

(56) References Cited

U.S. PATENT DOCUMENTS

| | | | | |
|---|---|---|---|---|
| 4,988,097 | A | 1/1991 | Smith et al. | |
| 5,566,869 | A | 10/1996 | Katz | |
| 5,607,090 | A | 3/1997 | Brown | |
| 6,173,866 | B1 | 1/2001 | Taylor et al. | |
| 6,325,246 | B1 * | 12/2001 | Crawford et al. | 222/79 |
| 6,415,960 | B1 * | 7/2002 | Fink et al. | 222/175 |
| 6,814,260 | B2 * | 11/2004 | Caffrey | 222/175 |
| 2006/0151552 | A1 * | 7/2006 | Shitaye | 224/148.2 |

OTHER PUBLICATIONS

PCT International Search Report for PCT/GB2007/050337, Sep. 26, 2007, 5 pages.
PCT Written Opinion for PCT/GB2007/050337, Sep. 26, 2007, 6 pages.

* cited by examiner

*Primary Examiner* — Lien Ngo
(74) *Attorney, Agent, or Firm* — Reising Ethington P.C.

(57) ABSTRACT

A liquid dispensing apparatus securable to the arm of a user comprises a liquid vessel (A) having a chamber for receiving and storing liquid, a liquid conduit having a first end in liquid communication with the chamber and a second end connected to a conduit valve for controlling the flow of liquid through the conduit, and at least two securing members (B, C) for securing the apparatus to an arm of a user, the first member (C) comprising a glove support for coupling to at least a portion of the user's hand and a second member (B) for coupling to the user's fore-arm.

29 Claims, 6 Drawing Sheets

Figure 1:
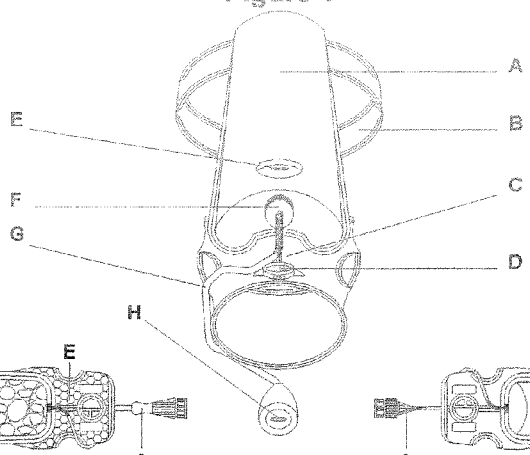

Figure 14
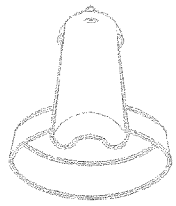
Figure 15
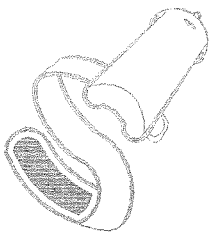
Figure 16
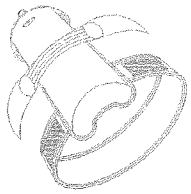
Figure 17
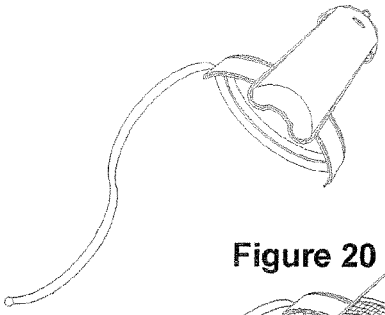
Figure 18
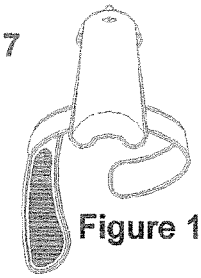
Figure 19
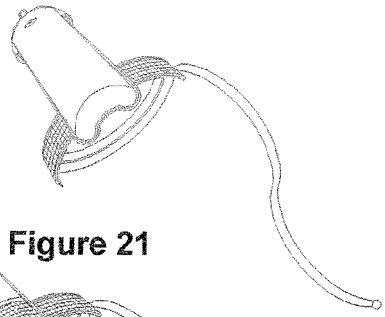
Figure 20
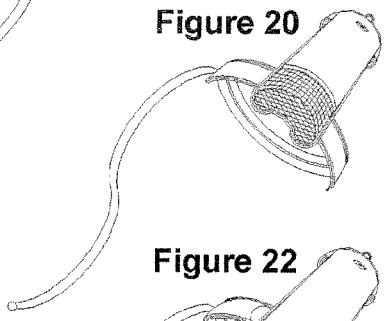
Figure 21
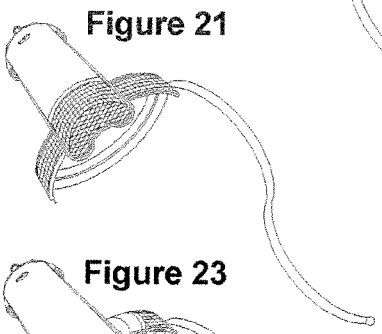
Figure 22
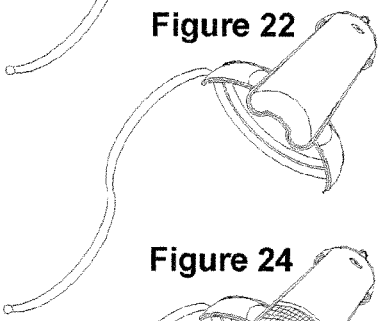
Figure 23
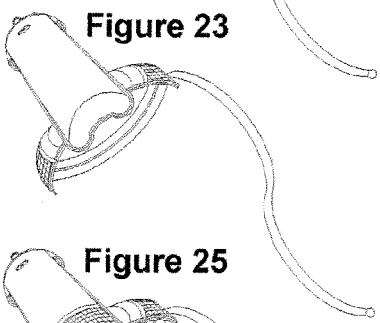
Figure 24
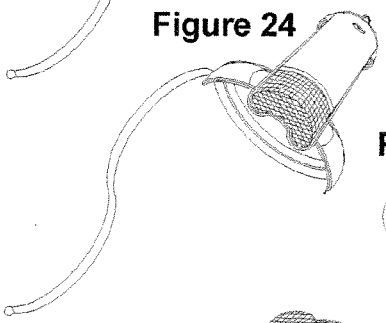
Figure 25
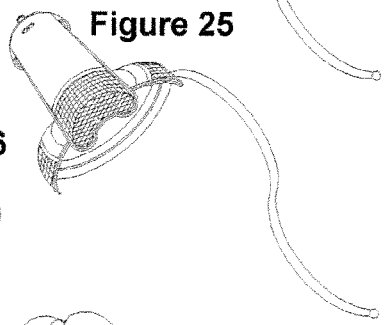
Figure 26
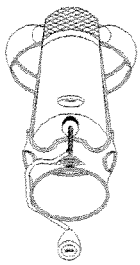
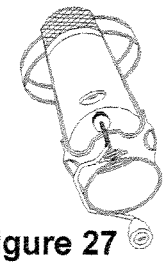
Figure 27
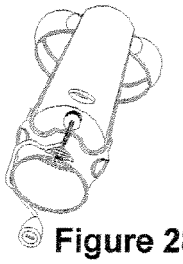
Figure 28

Figure 29
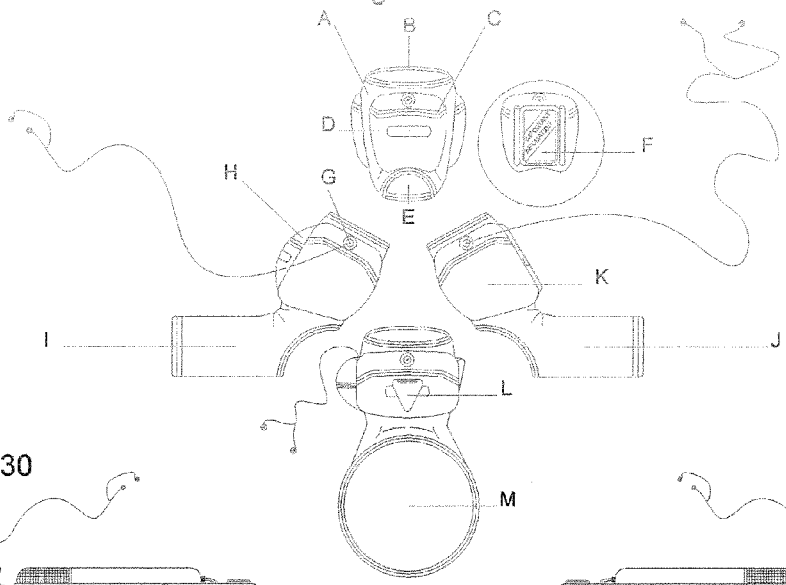
Figure 30
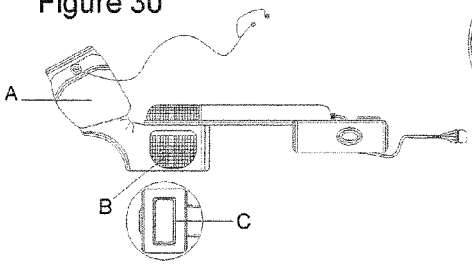
Figure 31
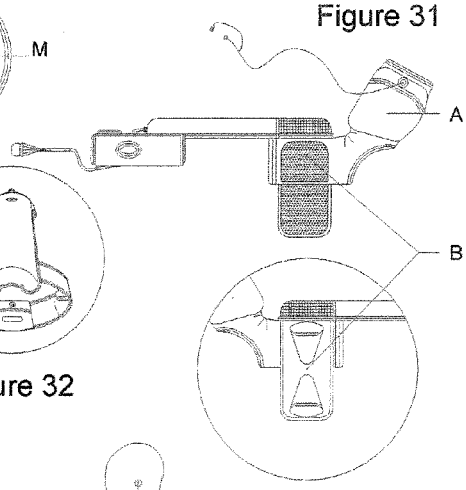
Figure 32
Figure 33
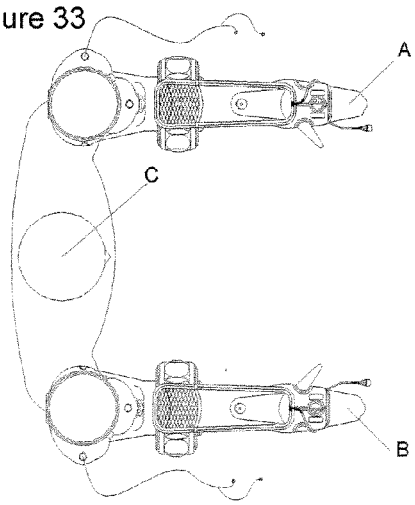
Figure 34
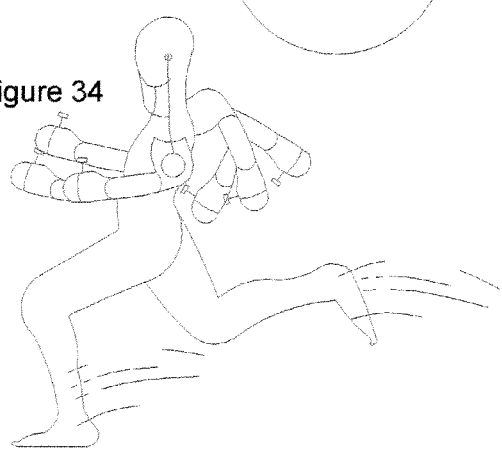

UTILITY HYDRATION SYSTEM

BACKGROUND

When participating in a sporting activity such as long distance running it is important to stay hydrated. It is important an athlete restore their body water content to avoid heat exhaustion and dehydration, this is integral.

TECHNICAL FIELD OF THE INVENTION

This present invention relates to an elongated generally rectangular elliptical shaped semi cylindrical refillable liquid hose pipe with mouth value bottle, that is stead fast to ones wrist, hand and fore arm by means of the appropriate materials and fabrics, the bottle is shaped to chamfer to the contours of an athletes fore arm, a support strap rests on the flexors of the fore arm while the hand and wrist are cuffed and sleeved with a ambidextrous glove support. Coalescing with this main present invention is a series of variants designed for storage these utility storage units will cargo personal and specialist effects. The present invention is mainly for sports enthusiasts, such as long distance runners, tennis players, badminton players, bicyclists, hikers etc. in fact just about any none contact sport, but at the same time it doesn't limit itself to one particular knish, as this hydrate bottle can be deployed in a variety of activities anytime anywhere, even if you are on a recreational day trip, or just walking along the high street while shopping. So it is a practical efficient unproblematic transporters drinking system that allows a person to hydrate at will, whilst still having usage of both hands in motion.

Until the present invention, people were disadvantaged by a limited market place when pursuing physical activities coupled with the need to hydrate, however adequate for specialist situations other harness hydrate system plus sports cap bottle systems are, they define inherent limitations, as regards to identifying neglected fields of scope, although other harness systems perform well towards arduous prolonged physical endeavour, but when considering competitive sporting endeavour, this demands a far more user friendly device.

The main constituent of these limitations include hindrance towards ones performance, as what is the profit to a sports person to employ such a specialist item for hydration, when in fact in this area of scope this item would greatly hinder the mobility and performance.

These limitations due to far too cumbersome harness systems e.g. belly bags, rucksacks and hand held sports cap bottles place no concern towards efficiency of ergonomics whilst aspirating towards a desired athletic objective.

In many situations where one is competing with another athlete is it likely that this individual would consider existing harness hydrate systems as an advantage or disadvantage when needing to hydrate coupled with performance, also the location of the present hydrate systems placing emphasise solely onto a person's lower back, then once again is this the most effective location, in other words would an athlete be prepared to risk a long term injury.

In still another situation you can't refill existing hydrate harness without stopping to remove the entire pack, resulting in an athlete losing time during the refill and possibly a race. An athlete would not wear these existing items, as they do not do so as it is.

Admittedly there are some excellent selections of hydrate systems on the existing market and admittedly there are various hydrate systems that perform an excellent job, and they are designed well, but only for there own particular specialist fields. Whilst disregarding any of the specialist needs demanded by competitive sports plus even none specialist recreational day trips. Also it can be envisioned that my present invention would also function well in the specialist field of survivalist pursuits.

In light of these problems it is the object of the present invention to provide a means of hydration that places more emphasis on ergonomically sound anatomically correct efficiency coupled with economy in simplicity.

OBJECT OF THE INVENTION

Object of present invention is to provide a hydration system deployed on ones arm by means of secure strapping devices which are ergonomic with anatomical deliberation coalescing towards efficiency.

In light of the foregoing problems and to fulfil the above stated objects, it is the gist of the invention to provide a stream line refillable harness hydration hose and mouth valve system that places emphasis on ergonomically sound efficiency. This refillable hydration system coalesces to the person's wrist and fore arm by means of an ambidextrous glove and fore arm strapping.

It is another object of the present invention that firstly this design perform its duty of a hydrate system while secondary it provide scope for several embodiment ranges that will perform the duty of storage, these ranges can be construed for usage in the recreational spectrum of the present invention.

While it is still the further object of the present invention to also provide the correct balance of functionality with economy of space and technical aesthetic which gratifies the eye with pleasing apparel.

It is another object of the present invention that not only does it relate to sporting activities and recreational purposes that it will correlate well in the specialist fields of survivalist pursuits also.

SUMMARY OF THE INVENTION

The present invention relates to a water tight utility hydrate storage chamber contoured to fit fore arm flexors entirely carried thereon by means of a main support strap and ambidextrous glove; said water bottle further having a water tube fluidingly connected to said water storing chamber and outwardly extending there from, and consequently out of said bottle so as to allow the wearer of said bottle to drink water from a variety of mouth operated water valve head attachments, while concurrently deploying said chamber bottle thereon fore arm hand and wrist, wherein said bottle is held with stability supported on a persons arm.

The present invention corresponds to a drinking system that allows fitness enthusiast to drink anytime they desire. More particularly the present invention is a sports bottle consisting of a main body adapted to fit onto a wears fore arm and wrist. Present invention pertaining to a water bottle of the type, protrudes a flexible water hose outwardly extending from water chamber, allowing water to be drunk by wearer of this said bottle through a variety of mouth operated water valves.

The present invention also relates to a refillable water bottle with hose and mouth valve system that in tern is strapped to ones fore arm, hand and wrist, comprising of:— a) An elegant main body contoured to fit onto a wears fore arm hand and wrist so as both become integrally linked to each other b) Liquid exits water chamber passes through a flexible tube on route to mouth by means of a controlled mouth operated value, were liquid is obtained thusly there from c) optional storage units apply as regards individuals necessity The invention may utilize a honeycombed material, housed inside the vessel, to alleviate or combat a sloshing motion whilst in use.

STATEMENT OF INVENTION

The utility system comprises of the main function pertaining towards unlimited hydration, while in accordance with the secondary optional aspects of the product e.g. storage.

To overcome this, the present invention proposes a direct route from the refill arm bottle to a persons mouth with the means of a tubular length hose plus valve connection; in turn the motion of a persons arm when needing to drink is in fact the same manoeuvre as a person checking the time of there watch, importantly the leverage of the arm in this position combined with gravity forces the liquid towards the hose end of the bottle which then in turn maximises the entire volume of liquid contained in the bottle, enabling the person to engage fully and satisfactory with the refill arm bottle, when the bottle does become exhausted of it liquid as is likely, there is also a refill push valve that is universally ergonomic with all types of water to sports drink bottles plus tap faucets. The position of the refill valve is generally central to the top face of the bottle but can be positioned at either the back end or front end of the bottle, the function of the refill valve is made more appealing in its apparel by adding stylized protruding edging around its perimeter, in doing so an extra volume of liquid is in turn achieved.

This present invention relates to a water system that is fastened by strapping to ones fore arm, wrist and hand, with optional storage pouches for carrying personal plus specialist effects. This present invention is mainly for the plethora of none contact sporting enthusiasts, but does not have to limit its market potential solely in this field, as its embodiment variants make this item a general purpose utility storage system as well, to be used anytime anywhere for recreational purposes and even high street errands.

While although there already exists, means of hydration, these means remain inefficient, as it is difficult to access beaker or bottled water while in motion, even sports cap bottles remain ineffective as a runner has the inconvenience of carrying this item either in hand or having to employ extra garments such as waist bag to store this bottle weather full or empty, or even in extreme frustration discarding this purchased item. Equally it is rather cumbersome to carry similar designed items that attach themselves to other locations of the human anatomy, so purposely designed as to relate to distinctly different activities. To use these similar items it can be accessed, could only restrict any athletes attempt at a good and satisfactory performance.

Present invention serves the same goal of hydration as does existing products, and even with akin apparatus, but specializes more for the professional sportsmen and or everyday sports enthusiast, it equally serves recreational needs, rather than solely that of the specialist field of camping, that's not to say a camper cannot also benefit from this present invention, the refillable hydrate system. This gives the customer extra options and compensates a one dimensional market, it gives a particular customer a more precise refined system for usage in there fields of scope. It can be used anytime anywhere on a hot day, or in the case of a thermal flask variant, used on a cold day also. So in fact it actually caters to a variety of knishes, and not just the gamut of sporting pursuits.

Present invention performs the same hydration job, but in a different medium, plus the location of this bottle strapped to the fore arm and wrist aids with the efficient deployment of liquid while an individual can remain focused on the goal of robust motion, such as running, tennis and so forth, so just about every none contact sport which have no defined intervals were one would need to stay hydrated is applicable towards this bottle.

What makes my design so different towards all others on the market is its organic relationship with the human anatomy it is far more sympathetic less cumbersome more like an extension of anatomy rather than a device placed thereon, there's advantages of efficiency as well, the arm and hand are the natural utensils that conduct the condiments to ones mouth in a far more elegant and graceful way with finesse, it just looks right with an anatomical correctness, no hindrance.

More practical than its counterparts, it's sensible to place such a device on ones arm rather than the lower back area, which could only result in back injury when tackling a competitive activity were every moment counts.

This present invention exploits the gap between sports cap bottles and camping hydration goods, these two ranges seem to be fairly ineffective hydrate systems when considering this neglected scope, this is due to hindrance of ones performance when contemplating competitive activity, even the potential market of everyday usage is lost, as not many people would be prepared to wear such an item, fashion conscious teenagers wouldn't for one, as its aesthetics haven't the street appeal as I believe mine might. As for instance camping hydrate systems are biased towards survivalists activities and a particular type of person, whilst sports cap bottles hinder performance e.g. haulage of, with or without waist bags, plus when exhausted of content there is little to no chance of an individual refilling them, sports cap bottle only come into good effect during intervals of activity e.g. half time in team sports. Comparable inventions viably reconsidered as regards to this present invention:—

Admittedly present invention redefines the qualities of existing products, but serves economy of space with functionality plus a technically commercial aesthetic which gratifies the eye with pleasing apparel. This anatomical proficiency is realised by the natural compatibility towards this supersede anatomical location in this field of scope. This in tern enhances functionality with efficiency coupled with good aesthetics, creates a balance that is effortless and elegant. This product delivers on all of these aspects discussed; it also vastly improves the ratio in equilibrium as pertaining burden of load amalgamated towards technical predetermined consumption volumes. Importantly the design has utilised the manufacturing standard quantity of 500 ml, this capacity of 500 ml has been determined as comparably shaped condiment such as shampoo bottles range at this estimate, coincide this with average lengths of both the male and female radius plus ulna bones being around 220 mm, then with the simple equation for cylinders $v=\pi r^2 \times h$, an evaluation in volume can be reached of 977, divide this number by 2 to create the volume for a semi circular cylinder and the figure reached is 488 ml, so if you then take into account the above stated aesthetic and the multitude of variables possible when moulding such an item, again you not only mould this container to be visually pleasing, you also in the same process create a very practical means of increasing the capacity, so for arguments sake by just adding upwardly facing ridges with themed shapes, this can then in turn create any extra volume necessary towards this vessel. In simpler terms 500 ml is a manufacturing standard in which this invention delivers once again. This miniscule weight of 543 grams which is the weight ratio of 500 ml plays no part in the hindrance of performance, but is in fact a universally excepted volume of liquid defined to reward the consumer thusly, while the child's version holds a volume of 250 ml, which is a standard measurement also. But regardless to this achieved consumption value the hydrate system is not dictated to, as the refill valve professes yet more efficiency.

This present invention addresses the imprecision's of my chosen spectrum of scope with what already exists on the market, yes other hydration systems are excellent for there criteria e.g. backpack versions for camping but then in turn neglect sporting and recreational usages of the hose and mouth valve hydration system, my present invention investigates meticulously the potential of this new criteria of scope by discussing; function, efficiency, balance, aesthetics and superior organic ergonomics. So as my present invention exploits the gap of ineffective existing ranges that are the preserved of survivalist activities. It is just, good common sense to place the convenience of a hydration system thereon an individuals arm to create this envisioned balance.

Concurring Metaphors:—

To state a simple analogy these existing products compared to mine are the difference between a fork and a spoon, of course they both serve the same desired effect, but in a relatively different facet to each other. To reiterate the existing products and my present invention, they both serve the same hydration theme, but remain the difference between a C.D. diskette, in comparison to a VHS video tape. They are orientated towards the same service but provide this in divergent fields. Another related metaphor that can illustrate the differentiation of these hydrate themes is the relationship in accordance of a can towards a bottle. An old fashioned pocket watch was made far more effective as a time keeping device when the wrist became its anatomical location, so I feel similarity towards my present invention; in this related activity you can check the time of your wrist watch and keep on the move without the rigmarole of stopping everything to produce this item from a pocket, likewise the utility hydrate system delivers the same upgrade of efficiency; your hands are unrestricted and the application of the bottle e.g. deployment of, is actually the same simple manoeuvre as checking your watch, this states simplicity and functionality. Like a pocket watch existing hydration harnesses effectiveness would increase as an aid if situated upon arm, so just like the modern wrist watch, my present invention frees up ones hands, crucially this would be in keeping with present trends of hands free bluetooth headset mobile devices etc.

So to recap present invention allows the wearer to drink through said hose pipe mouth valve; while main body e.g. container, is concurrently fastened to ones hand wrist and fore arm; while remaining active and hydrated without the inefficient transportation methods of other existing designs. While understanding the needs of other related pursuits, and in turn opens up new markets.

The present invention relates to a refillable hydrate bottle that is slipped and fitted securely over fore arm wrist and hand with an integral hose pipe plus mouth valve, and more particularly to a system of drinking that is far more elegant and efficient than any other in its field of scope. It accommodates in a far more precise way a neglected area of the clientele. It is as if it was ergonomically meant to be placed on ones forearm, rather like a wrist watch in fact.

This present invention is a harness that industriously provides the purchaser with a hands free dynamic for replenishment of liquids while remaining dutiful towards prolonged physical activity. This hydration pack coalesces to ones hand, wrist and fore arm by means of appropriate fabrics and materials.

Aesthetics Discussed:—

Usage of the already tried and tested contemporised sports materials can and will be the basis of my present invention, theses materials will lend themselves well and will consist of the usual preferred plethora of sheik sporting fashion materials and fabrics. The materials of this hydration system will be fabricated from any number of materials well-suited for the entire spectrum of this given field of scope.

All fabrics and materials towards this design will be fashioned to be ergonomically sound, while aesthetically pleasing, as will the moulded plastic refill bottle itself. This aesthetic look of the system, will fashion to suit any preference in shape and theme put on by consumerist specifics. As the system will be a fashion statement to the purchaser, as it is worn rather than carried; designs will in turn conform to gender, age etc. e.g. masculine and feminine, adult and youngster, variants will be contoured appropriately. The ranges of emotive colour will be dictated so by an individual's preference whilst, coordinated to suit all apparel.

Infantry of compliant fabrics and materials, as held to humans fore arm wrist and hand include a multitude of appropriate body fabric cushioning materials, nylon-mesh foamed materials for extra padding; elastic gathers which snugly hold in place with continuity to ones form, producing comfort; stretchable flexible resilient durable elasticized materials, and perforated materials preferably made of waterproof fabrics so that the pouch held personal effects remain impervious of perspiration and or rain water. Preferably this item can be produced by modifying existing products with machinery that is already in place. Maintenance of hydrate system, it could quite easily be cleaned in a washing machine, as are training shoes.

However the preferred materials and composition of the hydrate system can be suitably chosen by the persons skilled in the art. In according with the preferred prior art embodiment.

Alternatives Toward Already Existing Rubber Bite Valves:—

Internally enclosed sport cap valve; this is a sports cap variant with a grip circumference which has a hollow stem section that is rippled on the outside and inserts itself into the smaller radius of the plastic hose pipe tube, which then in turn is held in place by tension.

Externally correlated sport cap valve; this is a sports cap variant that has the plastic hose pipe tube inserting itself into a hollow bulbous bottom, this bulbous portion is rippled on the inside then continues upwardly by means of a hollow stem shaft that is thinner at the bulbous end then enlarges in a tubular gradient and ends at the sports cap section itself this is designed thus, to deny any further penetration of the plastic hose pipe into the stem as this bulbous section of the variant is similar in diameter to hose pipe. This hose pipe is then in turn housed in place by means of this ergonomically determining shape plus tension. Externally this sports cap version also has a grip circumference that allows for easier detachment. These two editions are sufficiently different in form to the popular screw bottle variety.

My rubber bite valve variance; my design in its function has a series of minute parallel puncture holes all housed within the entirety of the circular perimeter of my bite valve. Its application is not dissimilar to that of an infants bottle, the inner liquid is released in a similar fashion when lateral pressure is applied thereon. While the rubber bite valves that already exist on the market at present consist of an enlarged single slit opening for engagement of liquid, these items differ mostly in there apparel but equally my over all utility hydration unit, will be able to accommodate and be user friendly towards already existing rubber head bite valve systems.

Hard plastic latticed gate mouth valve with wheel opening key, either with hard plastic mouth piece, or rubber head mouth piece; The top mouth section is designed to be a ergonomically determined elliptical shape it is made of rubber or hard plastic so as to fit in front of a person's teeth and gums, and is proportioned thusly. The hard plastic hollow valve section is designed to house three parallel through compartments of latticed gates. These gates in turn hold the liquid in place by surface tension, until engaged. The wheel section has an even smaller exit hole that is minutely latticed. So if you want to deactivate device and stop the flow of liquid all you need do is turn the wheel lip accordingly, which is located on the external face of the valve wheel this device is similar to the parmesan cheese containers you can get but is unique in its usage as a sleuth gate for liquids. The remainder of the design is similar to my external sports cap variant. With all of these variants one could satisfactorily swig a sip of liquid virtually every other yard.

Bottle to Hose Pipe Solutions:—

One such solution is; situated at the glove end of the bottle is the screw cap straw mechanism, this mechanisms screw thread is designed to screw inwardly, similar to a hot water bottle but minus the projection of its key section, the grip of this plug stop is comparable to the grip of a whiskey flask screw cap, this marriage of rudiments is to eliminate any restrictions around the joint of the wrist and fore arm, so as to allow full maneuverability when in motion, it is also hollow with an extendable bendy straw attachment with ridged nib, which in turn allows liquids to flow directly threw it when being operated, the straw element of the thread ambidextrously bends right or left depending on what fore arm is the users preference, when unscrewed this perforation of the bottle is the main spigot in which is poured the firstly volume of liquid.

Another solution is to eliminate the screw cap altogether and simply mould the entire bottle to include a protruding in built straw section at the same location at the glove end of the bottle. In doing this all liquids entering this container will do so through refill valve, the hose pipe will perform it same duty all with an ambidextrous feel.

Forearm Support Strap Solutions:—

The two main methods of strapping:—one could be a synthetic sports material perforated elasticized padded fore arm unitary support strap positioned at forearm end of the bottle, this component is in the form of a cross-arch strap loop, both ends of this loop then attach in parallel to the underneath section of the lipped perimeter of the bottle, by means of stitching combined with glue. Attached to the underbelly of this bottle is a cushioning panel material, that is similarly glued and stitched onto the underside surface of the bottle, as a result the glued and stitched sections of the support strap are then sandwiched in between both bottle and panel material, while the cross-arch strap section of this loop is left independent of the main body, this cushioning material as a consequence, will then rest comfortably onto the brachio-radialis fore arm muscles.

The other version involving velcro would be glued and stitch to the cushioning and bottle sections in the very same fashion of the unitary strap but the difference being that this variant would be in the guise of, two equally sized parallel wing straps that would bond to one another with the usage of velcro to visually encompass each other to give a seamless and continuous look which is in keeping with the ambidextrous theme.

Advantages

The location of the bottle being stead fast to the arm, lessens any impediment or disadvantage of a person in motion who is also in need of a means of constant hydration, he or she need not lose pace nor stop.

This preferred invention prevents any and all undesirable accidental displacement of liquid while in sudden and prolonged motion, when needing to hydrate, this lateral displacement of liquid occurs mostly when drinking from a beaker. A flexible plastic tube allows liquid flow there through only when engaging correctly with mouth valve thereon e.g. by operating in accordance towards any of a plethora of mouth valve attachment. Fastened to the wrist and fore arm of the user with stretchable material, the fore arm limb band is slipped over the hand then up the arm to rest on the flexors, while the hand and wrist are cuffed and sleeved with a ambidextrous glove, to leave no doubt of its stable rigidity in adhering toward rapid bursts of speed.

Firstly it vastly improves the ratio in equilibrium as pertaining burden of load amalgamated towards technical predetermined consumption volumes. Importantly the design has utilised the manufacturing standard quantity of 500 ml for adults and 250 ml for children, these capacities have been determined as comparably shaped condiment such as shampoo bottles range at this estimate, coincide this with average lengths of both the male and female radius plus ulna bones being around 220 mm, then with the simple equation for cylinders $v=\pi r^2 \times h$ an evaluation in volume can be reached of 977, divide this number by 2 to create the volume for a semi circular cylinder and the figure reached is 488 ml, so if you then take into account the aesthetics and the multitude of variables possible when moulding such an item, again you not only mould this container to be visually pleasing, you also in the same process create a very practical means of increasing the capacity, so for arguments sake by just adding upwardly facing ridges with themed shapes, this can then in turn create any extra volume necessary towards this vessel. In simpler terms 500 ml and 250 ml are manufacturing standards in which this invention delivers once again. This miniscule weight of 543 grams for adults and 170 grams for children which are the weight ratios of 500 ml and 250 ml, play no part in the hindrance of performance, but in fact are both universally excepted volumes of liquid defined to reward the consumer thusly. But regardless to this achieved consumption value the hydrate system is not dictated to, as the refill valve professes yet more efficiency. Secondly it efficiently supplies you with liquid, without the inefficient inertia of sloshing or wastages or fuss e.g. this preferred invention prevents any inefficient displacement of liquid while pursuing prolonged activities while in swift motion, you are not just hauling this item around with you, as it has an organic relationship with ones anatomy. Thirdly allows the wearer to drink through said tube while concurrently strapped to ones hand wrist and fore arm while remaining active and hydrated, without the inefficient transportation methods of other designs. Fourthly it is less cumbersome for this particular activity than say other similar products. Fifthly it is a strap system that secures a refill hydrate vessel to the extremity of ones fore arm wrist and hand so as to cargo a copious amount of liquid therein; configured at opening end thereof, a flexible tube, water fed through a mouth valve when the correct modus operandi is applied; for a selectively controlled fluidity. Sixthly with the present invention the said hose pipe is relatively smaller in length than its counterparts effectually minimises the initial physical force necessary as regards the initial process of inhaling the column of firstly trapped vacuous air that is trapped inside the tube pre emission of its firstly liquid; hence the runner will not be made breathless with this procedure per says as they would with an arms length range. Advantageously the fluid flows by force of gravity due to the lateral upward tilt manoeuvre of ones arm whilst drinking. Once this process is initialized, then the air pressure inside bottle will egress liquid there from by means of controlled flow when the correct procedure is applied towards mouth valve, so as to fully engage all liquid content within the bottle container. This bottle is designed to entirely empty of its content to then be refilled if necessity dictates. Seventhly it has a glove and main support strap with cushioning panel material that allows the bottle to remain stationary as the arm extends upwardly and downwardly in rotating motion with shoulders in correlation with body, which allocates for unimpaired running with an aid to hydration and continuity. To leave no doubt of its stable rigidity without constantly stopping to replenish any lost liquids, adherent towards rapid bursts of speed. Eighthly environmental concerns are catered for too as this bottle is renewably refillable, while disposable bottle are not when in competition, this present invention would in turn produce less wastage for refuge collectors the next day from, e.g. Marathons, pentathlons etc. Ninthly assembly forms less manufacturing process in production, simplicity. Tenthly it can have incorporated onto optional storage pouches for personal effects such as nutritional bars and basic first aid kits etc.

Other Advantages of this Refillable Hydrate Hose Pipe Mouth Valve Container are:—

Glove element with an ambidextrous theme; this is especially advantageous for several reasons, to combats left and right hand preference of the purchaser, coupled with cost effective factory processes that inshore assembly costs are halved; the hydrate bottle has elastic gathers around rims edging of the glove and support strap to snugly form around limb; identifying a neglected potential market; producing an organic improvement; assembled form occupies less spatial area in ones apparel as regards existing products; improvements on mobility and flexibility integral towards prolonged sporting endeavour; the assembly can also serve a dual purpose other than hydration and storage needs; e.g. filled with hot water it can act as a heat pack for the strained and swollen limbs of the arms or legs, as it already contours the arm, while with no great stretch of forth sight the glove section can be slipped over the foot like a shine pad ankle support; equally it could be an ice pack as well. Also while running the bottle could act as a mini shower system, if you needed to cool your head rather than hydrate, this is achieved simply by raising ones arm above head, while operating release mechanism of mouth valve. These elements not only coalesce regarding theme and function they also state practicality with that of simplicity; the bottle is moulded to be contour wisely, to perform several duties; it is fashioned to be ergonomic while aesthetically pleasing;

This present invention is a harness that industriously provides the purchaser with a hands free dynamic for replenishment of liquids while remaining dutiful towards prolonged physical activity. This hydration pack coalesces to ones hand, wrist and fore arm by means of appropriate fabrics and materials.

INTRODUCTION TO DRAWINGS

Figure 2:
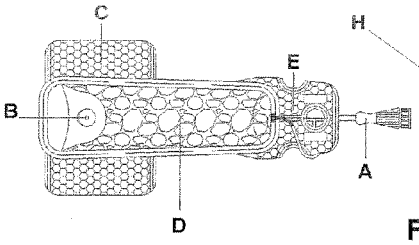
Figure 3:
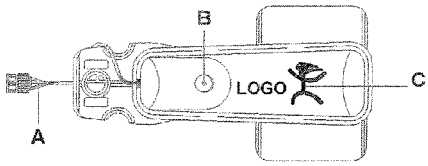
Figure 4:
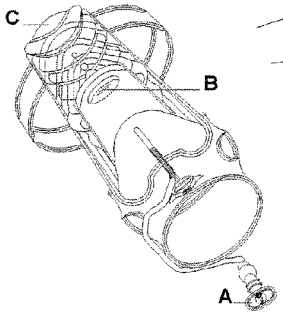
Figure 5:
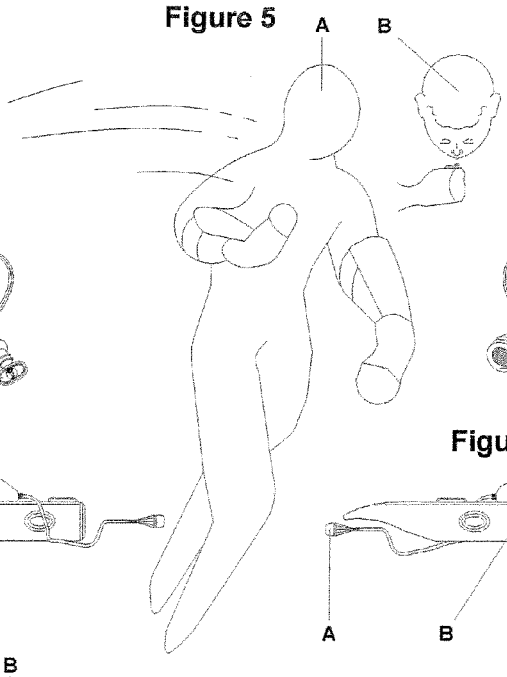
Figure 6:
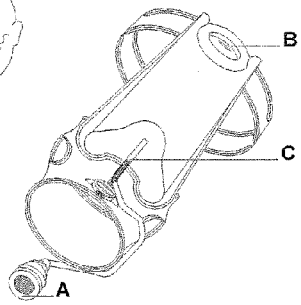
Figure 7:
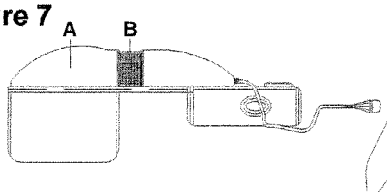
Figure 8:
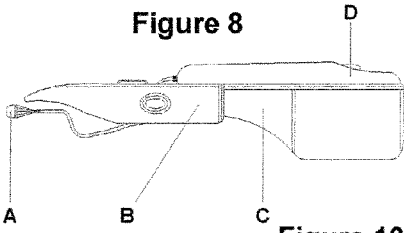
Figure 9:
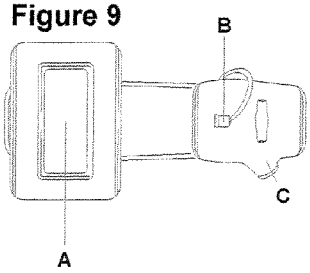
Figure 10:
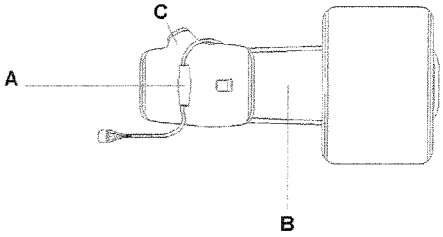
Figure 11:
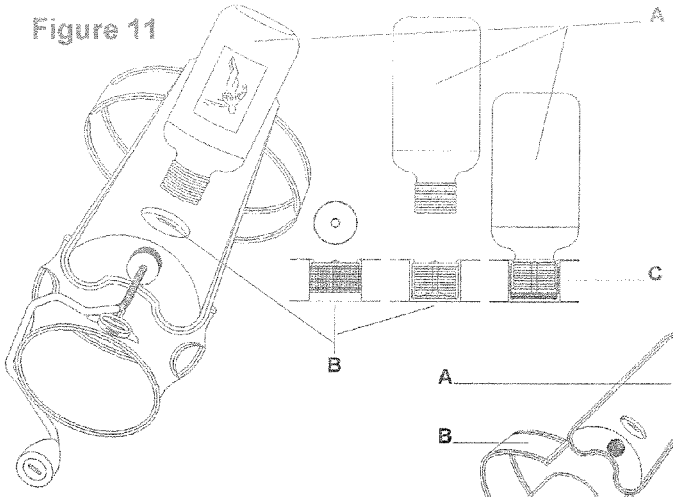
Figure 12:
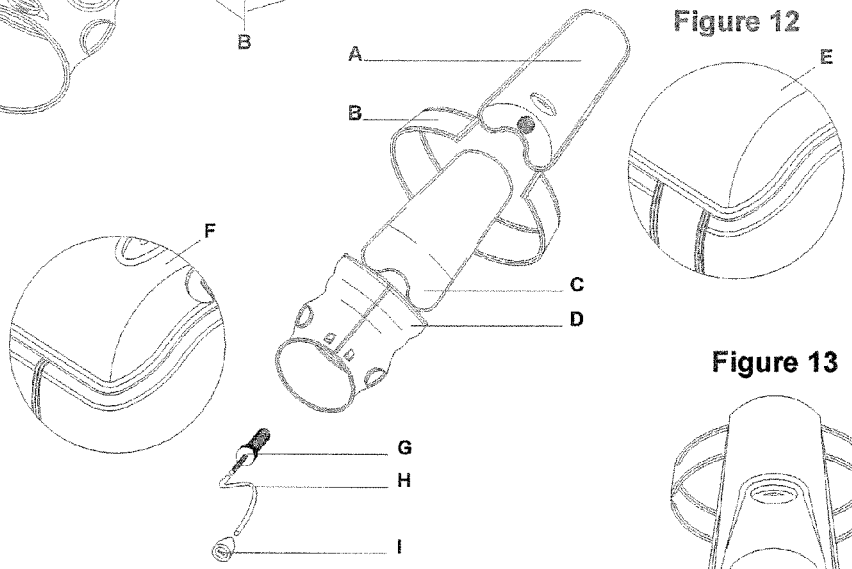
Figure 13:
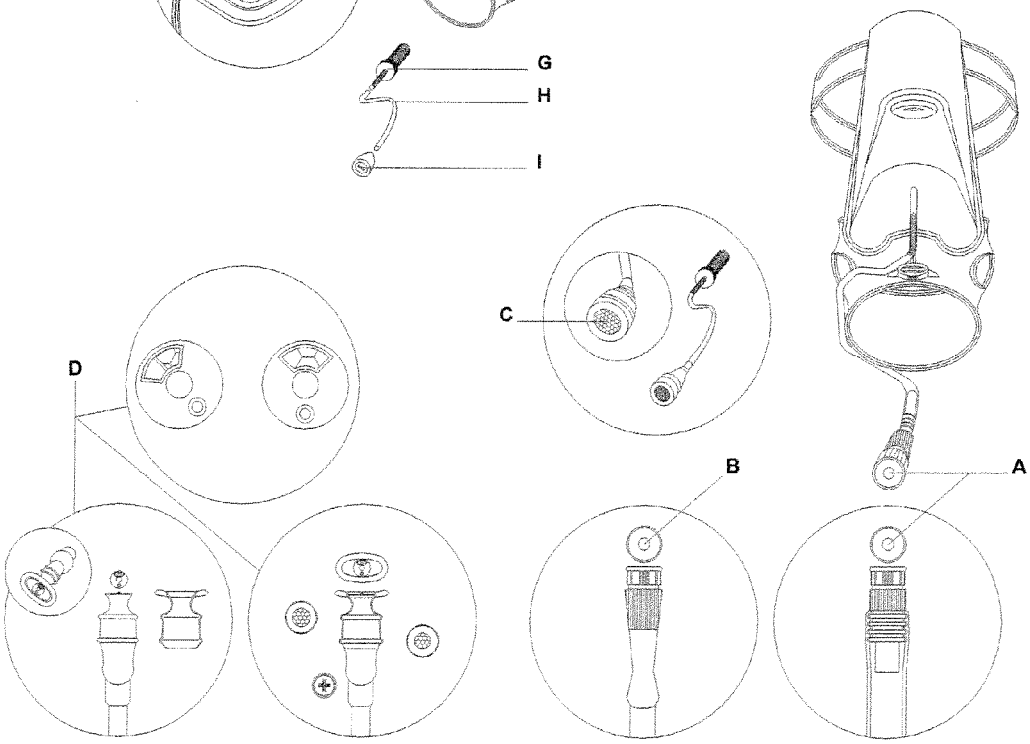
Figure 36:
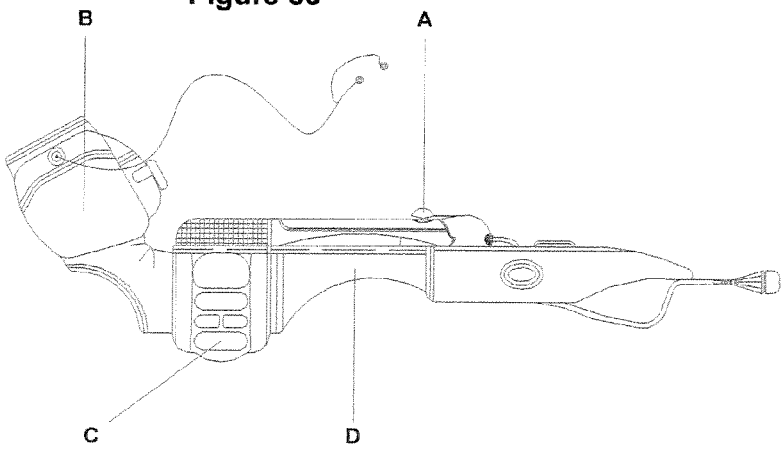
Figure 37:
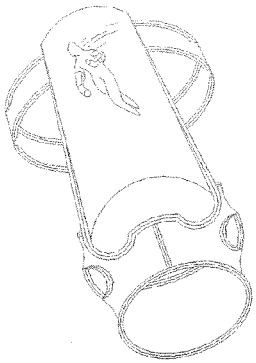

An example of the invention with all of its various nuances with embodiments will now be described by referring to the accompanying drawings:

FIG. 1*a* shows a fixedly attached e.g. sown; perimeter lipped water bottle fabric sewed beneath thereon, in accordance to the invention FIG. 1*b* shows a synthetic sports material perforated elasticized padded fore arm unitary support strap FIG. 1*c* shows a ambidextrous perforated elasticized glove support FIG. 1*d* shows a watch attachment FIG. 1*e* shows a water tight refill push valve FIG. 1*f* shows a hollow bottle screw cap with a protruding bendy fluidity straw tube attachment with ridged nib end fluidly connected to disconnectable flexible hose tube FIG. 1*g* shows flexible plastic hose tube which allows the flow of liquid FIG. 1*h* shows existing operatively rubber bite valve, indicating the user friendly design of the compatibility of the utility hydration system towards incorporating existing items FIG. 2*a* shows an alternative toward already existing rubber bite valves; e.g. my variable a externally placed sports cap FIG. 2*b* shows back location of refillable valve FIG. 2*c* shows forearm strapping perforated sports material FIG. 2*d* shows elaborately textured bottle FIG. 2*e* shows ambidextrous glove perforated sports material FIG. 3*a* shows an alternative toward already existing rubber bite valves; e.g. my variable a internally placed sports cap FIG. 3*b* shows front location of refill valve FIG. 3*c* shows logo positioning location FIG. 4*a* shows an alternative toward already existing rubber bite valves; e.g. my variable a lattice gate mouth valve FIG. 4*b* shows a centrally placed refill valve encased into a themed bottle shaping FIG. 4*c* shows elaborately moulded bottle FIG. 5*a* shows an illustration of an athlete clarifying usage in motion, as pertaining present invention FIG. 5*b* shows an illustration of an athlete clarifying usage of the hydrating method, as pertaining present invention FIG. 6*a* shows an alternative toward already existing rubber bite valves; e.g. my variable a rubber latticed bite valve FIG. 6*b* shows location of screw removable refill valve variant FIG. 6*c* shows variant of hydrate bottle with in built protruding straw moulding FIG. 7*a* shows a canvas bladder pouch variant FIG. 7*b* shows a cutaway of the refill valve illustrating its hard cylindrical perforated shaft which remains ridged as the canvas bag collapses when emptying of its liquid content FIG. 8*a* shows an alternative toward already existing rubber bite valves; yet another internal stylized variant of my sports cap FIG. 8*b* shows an ambidextrous mitten variant FIG. 8*c* shows glove to fore arm sock variant, the sock could even replace the glove as the means of wrist strapping FIG. 8*d* refill valve encased within a theme but located towards the back of the bottle FIG. 9*a* shows translucent sleeve pocket for displaying important personal information, in case of emergency FIG. 9*b* shows mouth valve housing pouch FIG. 9*c* shows an ordinary glove that is not ambidextrous from one side FIG. 10*a* shows hose pipe junction pocket FIG. 10*b* shows cushioning under section fabric panel integrally sewn and glued thereon underbelly of bottle the assembly consisting of the already above mentioned articles with the glove and main strap support all attached to this panel of material also FIG. 10*c* shows an ordinary glove that is not ambidextrous from the other side FIG. 11*a* shows a commercially purchased plastic water bottle in operational usage FIG. 11*b* shows the mechanism and external face of the refill valve FIG. 11*c* shows the realisation of the water system with the refill value explained FIG. 12*a* shows an elevation of the water bottle system depicted in progress pre assembly, this over all observation exhibits a greater illustration which elucidates all elements of said item with a fragmented perspective, to clearly drum home the relatively simplistic design of mentioned present invention, coupled with the realisation of an unchallenging assembly in manufacturing processes FIG. 12*b* shows an elevation of the main forearm strapping depicted in progress pre assembly FIG. 12*c* shows an elevation of the cushioning material depicted in progress pre assembly FIG. 12*d* shows an elevation of the ambidextrous glove depicted in progress pre assembly FIG. 12*e* shows visualisation of an exploded casement showing the back of said water system to indicate how its elements merge to create this final assembled product FIG. 12*f* shows visualisation of an exploded casement showing the front of said water system to indicate how its elements merge to create this final assembled product FIG. 12*g* shows an elevation of the screw cap bendy straw element depicted in progress pre assembly FIG. 12*h* shows an elevation of the plastic hose pipe depicted in progress pre assembly FIG. 12*i* shows an elevation of the mouth valve depicted in progress pre assembly FIG. 13*a* shows an alternative toward already existing rubber bite valves; Internally enclosed sport cap valve; exploded in size FIG. 13*b* shows an alternative toward already existing rubber bite valves; Externally correlated sport cap valve; exploded in size FIG. 13*c* shows an alternative toward already existing rubber bite valves; My rubber latticed bite valve; liquid is obtained by moderate pressure thereon bite valve as usual FIG. 13*d* shows an alternative toward already existing rubber bite valves; Hard plastic latticed gate valve with wheel opening key, with either hard plastic mouth piece, or rubber head mouth piece FIG. 14 shows back perspective of the unitary forearm support strap FIG. 15 shows adjustable velcro support belt FIG. 16 shows velcro detachable side bags FIG. 17 shows an additional smaller adjustable support belt, coupled centrally with a cushioning elasticized strapping material FIG. 18 shows parallel velcro wing straps equal in size and shape, that rap around and within each other to form a seamless bond FIG. 19 shows an additional smaller adjustable support belt, coupled centrally with a cushioning elasticized strapping material, plus wing elastic mesh bags FIG. 20 shows an additional smaller adjustable support belt, coupled centrally with a cushioning elasticized strapping material, plus elastic mesh bags FIG. 21 shows an additional smaller adjustable support belt, coupled centrally with a cushioning elasticized strapping material, plus wing elastic mesh bags combined with mesh bag FIG. 22 shows an additional smaller adjustable support belt, coupled centrally with a cushioning elasticized strapping material, plus side bags, used for energy bars etc FIG. 23 shows an additional smaller adjustable support belt, coupled centrally with a cushioning elasticized strapping material, plus side bags with mesh bag over lay FIG. 24 shows an additional smaller adjustable support belt, coupled centrally with a cushioning elasticized strapping material, plus mesh bag coupled with side bags FIG. 25 shows an additional smaller adjustable support belt, coupled centrally with a cushioning elasticized strapping material, plus mesh bag coupled with side bags and then with mesh bag over lay FIG. 26 shows elastic mesh bag plus strap side bags FIG. 27 shows elastic mesh bag FIG. 28 shows the main basic hydrate system including gusseted side bag; these variant embodiments 14 to 28 identifies recreational storage necessity FIG. 29*a* shows universally sized utility arm pouch adhered to fit the individual user for specialised storage e.g. mobile music entertainment systems, energy bars credit cards etc FIG. 29*b* shows elastic gather perimeter for a precise ergonomically sound fit FIG. 29*c* shows reference towards the opening of the triceps pouch and more precisely to the elastic lipped mouth FIG. 29*d* shows pouch unit with extra loop and hook attachment upon exterior sides of pouch bags FIG. 29*e* shows elbow location whence worn FIG. 29*f* shows in phantom the back pouch that rests on triceps, uncovering a pocket for small writing pad and or bank cards with loop pockets for small writing instrument FIG. 29*g* shows exit hole e.g. for ear phone leads FIG. 29*h* front pouch in usage e.g. filled with energy bars etc illustrating once again the ambidextrous quality of this item FIG. 29*i* shows the left flexor section to indicate its proportional mirrored continuity with right side FIG. 29*j* shows the right flexor section to indicate its proportional mirrored continuity with left side FIG. 29*k* shows right arm pouch in usage of a mobile music device FIG. 29*l* shows loop and hook attachment for hooking for instance a speedometer thereon FIG. 29*m* shows front perspective of flexor section of pouch with elastic gathers FIG. 30*a* shows the utility arm pouch system performing the dual purpose of storage and the actual main flexor support strap FIG. 30*b* shows the storage theme once again in the form of a set of elastic mesh side bags FIG. 30*c* shows another location of the translucent information sleeve FIG. 31*a* shows the utility hydration system amalgamated with the utility arm pouch system performing its duty as a pouch system plus as the main flexor support strap FIG. 31*b* shows the utility arm pouch flexor support strap hydration system with a Velcro wing strap with strategically placed exterior parallel pouch bags thereon FIG. 32 shows the utility storage system serving a dual but secondary purpose as while its firstly ultimate goal is that of a storage unit; it now reveals a secondary usage as an extra cushioning aid on fore arm when firstly purpose is not required, this illustration indicates the metamorphic versatility of said product, by now forming four equilateral cushioning pouches especially shaped, provided within the packaging to help with comfort. This only applies though if the pouch and hydrate bottle are stitched to one another in the frame work of the unitary support strap variant, as more than likely they will both be a separate item FIG. 33*a* clarifies ambidextrous qualities of present invention illustrated by an athlete in usage of, by drawing attention towards a mirroring parallel of the stretched out left and right arms FIG. 33*b* clarifies ambidextrous qualities of present invention illustrated by an athlete in usage of, by drawing attention towards a mirroring parallel of the stretched out right and left arms FIG. 33*c* shows an illustration of an athlete clarifying the ambidextrous qualities of present invention FIG. 34 shows both the refillable arm bottle with utility arm pouch in usage with the addition of a running figure clarifying both the hydrate and recreational theme, usage and anatomical location of both present invention; for illustrative purposes only FIG. 35*a* shows the housed zip bag thermal slide bottle FIG. 35*b* shows the insolating velcro hood, which is the continuation lip of the central zip bag material that is folded over itself to then cover the hollow of the zip bag were the refill valve is located FIG. 35*c* shows the location of the refill valve in relation to the refill hood FIG. 35*d* shows the velcro hood and exit hole of the thermally insulated hose pipe FIG. 35*e* shows an ambidextrous mitten FIG. 35*f* shows the insolating tube bag that houses the hose pipe and mouth valve with its tube bag lip opening at mouth valve end plus accompanying illustrations showing the hose pipe and mouth valve independent of the insulation tube FIG. 35*g* shows the removable slide flask thermally insulated bottle, plus a cut away diagram indicating how it is housed within a zip pouch bag itself FIG. 35*h* shows the bear mechanism of the slide bottle rail FIG. 36*a* shows side angle of the refillable valve system refill hood so as to leave no doubts about the hoods function FIG. 36*b* shows the combination of the housed thermal slide flask bottle and the utility pouch system FIG. 36*c* shows yet another embodiment within this storage theme; by highlighting mini side bags, mesh bags, hooks, loops, pockets etc FIG. 36*d* shows arm sock FIG. 37 shows a related embodiment, as with slight modification to the bottle, by this I mean seal the container completely, you could implant a highly viscous non-toxic reusable heat gel, which is ideal for bruising FIG. 38*a* shows yet another related embodiment a pouch bag with a Velcro hood that accommodates a commercial brand of reusable non-toxic heat gel FIG. 38*b* shows how gel pack is placed within pouch; for illustrative purposes only FIG. 39*a* shows the clamp mechanism with handle that clamps itself onto a commercial brand of polyethene plastic water bags FIG. 39*b* shows clamp and bag connected FIG. 39*c* shows a universal fitting shower head this embodiment is designed for a quick release of water so as to relieve an athlete from over heating; to be administrated by a coach etc FIG. 40*a* shows a universal shower head with a hollow stem that fits inside commercial brands of water bottles while the external grip section internally houses the universal grip hold adhered toward all bottled screw threads FIG. 40*b* shows a rubber squeeze bottle designed to accompany universal shower head FIG. 40*c* shows a commercial brand of water bottle; for illustrative purposes only Generally Stated the Utility Hydrate System Consists of:—

Referring to FIG. 1 as a Whole:—

The theme of the present invention in general relates to a refillable water bottle that is strapped to ones fore arm hand and wrist with an integral hose pipe and mouth valve, and more particularly to a system of drinking that is far more elegant and efficient than any other similar product on the market. The water system can be observed from a front perspective; a main body having a chamber filled with fluid and an access to the chamber; e.g. a flexible hose pipe and mouth valve, this tube having a first end in communication with bottle, and having a mouth valve on a second end; with a refilling mechanism located on top of hydrate system; so as to continuously replenish liquids whilst engaging the hydrate system, with the main target group being that of a sports enthusiast, while more particularly it relates to a system of drinking that is far more elegant and efficient than any other similar product on the market. Placed upon the underneath section of the main support strap is a translucent sleeve that will deem important information pertaining towards purchaser, plus with the option of side bags mesh bags hook and loop plus pockets etc, placed mainly thereon flexor support strap these storage units would principally house such items as a simple rudimentary first aid kit plus sports based energy bars raisins etc.

Referring to FIG. 29 as a Whole:—

The utility storage pouch system; this ambidextrous storage facility while deployed ergonomically to ones biceps, triceps and humorous would be considered to be far to cumbersome for competitive sports when housing MP3, iPods, mobile phones etc. this would be considered impractical unless storing energy bars, nutritional protein foods, raisins etc. But generally stated this item is ideal for recreational jogging and day trips, this item refers to the remaining aspects of recreational jogging e.g. the storage of mobile devices, and other related paraphernalia such as speedometers. Plus it can also be used to accommodate important emergency information about the purchaser in the form of a mini information booklet with pen, this booklet could contain contact numbers addresses medical requirement etc if purchaser is in need of medical assistance, you could even use the booklet to jot down other peoples details. Equally a rudimentary first aid kit could also be house within this unit. What this devise reveals is the variety of practicality that can be realised with this independent component you could even wear this item unrelated from this sports hydration theme.

Referring to FIG. 30 as a Whole:—

The utility storage pouch flexor strap hydration system; this system is a true amalgamation of both systems, it performs to all of the already mentioned objectives but adopts the utility storage pouch flexor section as the hydrate bottles main fore arm support. It can also be folded within itself as already stated this reveals yet another bonus namely the variety of diversity that can be realised with this separate component.

Referring to FIG. 31 as a Whole:—

The utility storage pouch flexor strap hydration system, with Velcro wing strapping plus external bags; this is exactly the same as FIG. 30, but it has a Velcro strap that loops around flexor portion of the storage pouch and is held in place with Velcro to give an even sturdier bond. The wing bags are designed to be right side up when strapped and in use on the fore arm, but when independent of bond one bag appears to be upside down. These two wing bags are designated mostly for energy bars.

Figure 35:
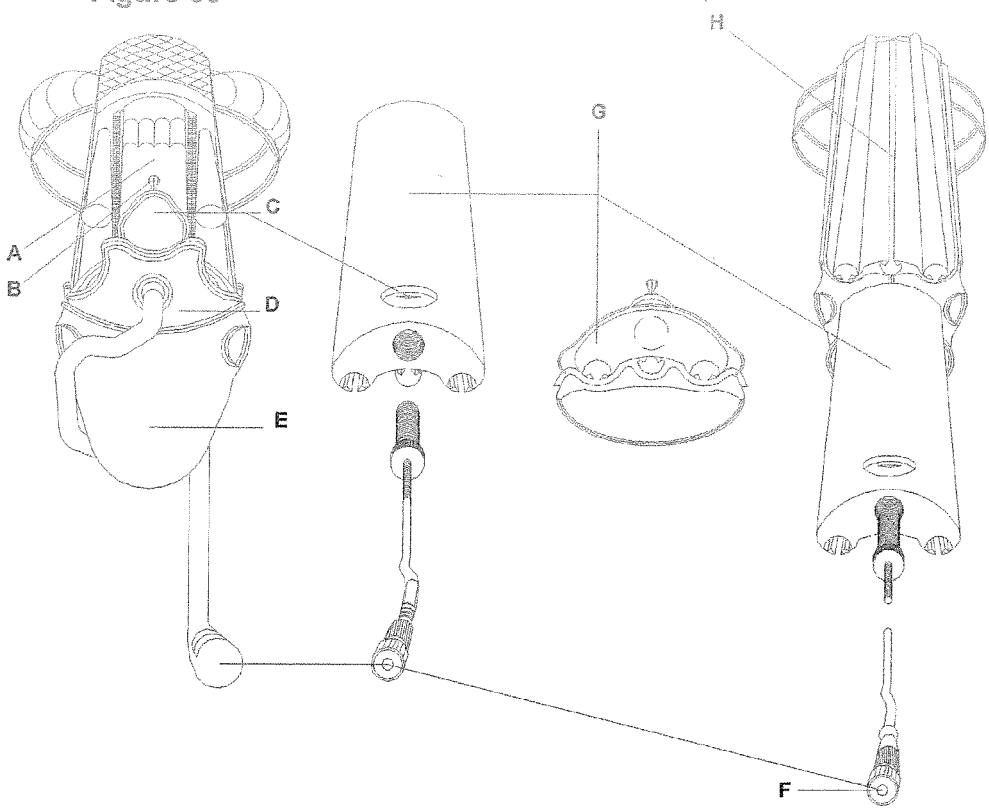

Referring to FIG. 35 as a Whole:—

The thermal slide bottle housed within zip pouch bag; this system is designed for day trips and or hill walking, not only does it provide a hot drink e.g. tea or even soup; but as it is strapped to the extremities of the wrist it also acts as a heat source to the body as not only does it rest on a number of important arteries so as to insolate the inner body core through circulation, you can also rap ones arms around ones torso etc and in turn fully thermo regulated ones person.

Referring to FIG. 37 as a Whole:—

The gel strap system; this is a related embodiment, as with slight modification to the bottle, by this I mean seal the container completely, you could implant a highly viscous non-toxic reusable heat gel, which is ideal for bruising.

Figure 38:
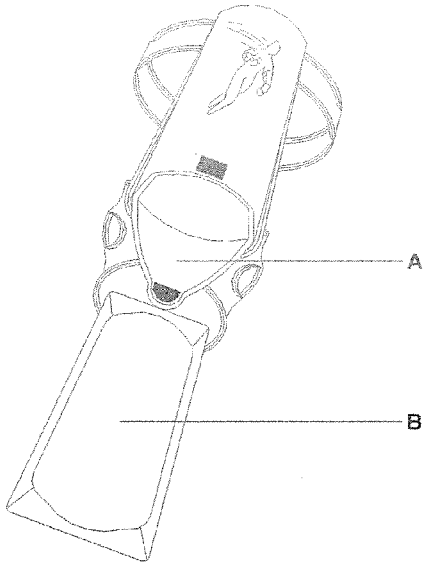

Referring to FIG. 38 as a Whole:—

The gel strap pouch system; this is yet another related embodiment it is designed to house the polyethene packs of commercial brands of non-toxic reusable heat gels available.

Figure 39:
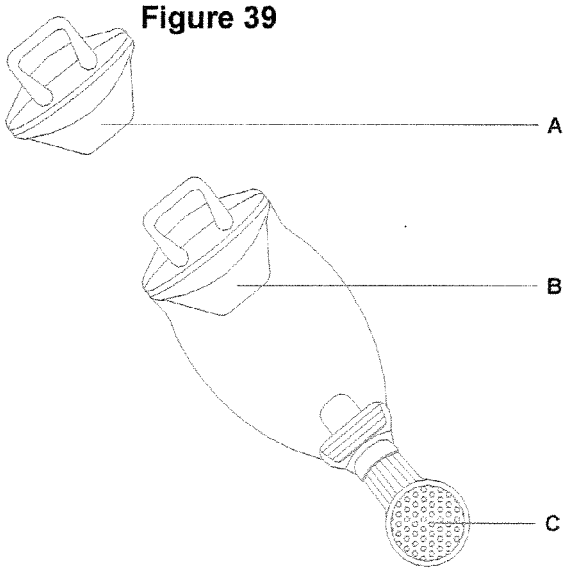

Referring to FIG. 39 as a Whole:—

The handle clamp with universal shower head: this is a bye product it is designed to cool down an athlete when over heated it can be administrated by a coach or trainer its application is best served in the sphere of training, it is designed to make use of the commercial brands of polyethene water bags.

Figure 40:
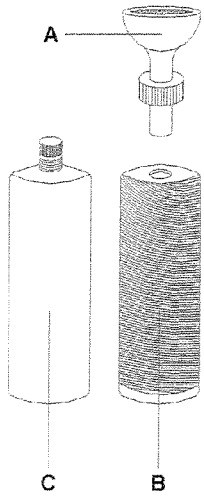

Referring to FIG. 40 as a Whole:—

The universal shower head plus bottle: this is another bye product it is designed to cool down an athlete when over heated it can be administrated by a coach or trainer its application is best served in the sphere of training. But it can universally hold a bond with commercial brands of water bottles but regardless to this it has its own squeezable rubber bottle accessory.

Other variants will no doubt occur to those skilled in the art upon the study of the detailed description and drawings contained herein. Accordingly, it is to be understood that the present invention is not limited to the specific embodiments descried herein, but should be deemed to extend to the subject matter defined by the appended claims, including all fair equivalents thereof. Any minor modifications to the present invention which do not deviate from the themed scope thereof are considered to be therein included. While a preferred embodiment of invention has been disclosed, various modes of carrying out principles disclosed herein are contemplated as being within the scope of the following claims. Therefore it is understood that the scope of the invention is not to be limited except as otherwise set forth in claims. While the foregoing embodiments are well suited to achieve the above stated objects, those skilled in the art to which the present invention pertains, should realise that such embodiments are subject to modification, alteration and change without departing from the scope and spirit of the present invention.

DETAILED DESCRIPTION OF THE PREFERRED EMBODIMENTS

A refillable ergonomically shaped moulded plastic water bottle, with dotted lip hollows centred about edging (1*a*) run along the majority of this perimeter, to form the means of linkage between elements by method of stitching, this component is in turn attached to three other components. At one end of the bottle, is a support strap (18) this component is in the form of a pair of parallel velcro wing straps equal in size and shape, were one raps itself around while the other coils itself within other one to form a seamless velcro bond, this bond in appearance then forms a cross-arch strap loop, both fixedly ends of this loop are attached in parallel to the underneath section of the lipped perimeter of the bottle, by means of stitching combined with glue. Attached to the underbelly of this bottle is a cushioning panel made from a already tried and tested material (10*b*), that is similarly glued and stitched onto the underside surface of the bottle, as a result the glued and stitched sections of the support strap are then sandwiched in between both bottle and panel material, while the cross-arch strap section of this loop is left independent of the main body, this cushioning material as a consequence, will then rest comfortably onto the brachio-radialis fore arm muscles. At the opposite end of the bottle is sewn a wrist and hand glove support (1*c*), which is designed to be ambidextrous for user friendly usage, this attachment is stitched to the under frame of this bottle and panel material, but unlike the support strap it is not sandwiched in between them. Elastic gathers for both glove and main support strap collapse thereon into a constricting but comfortable position onto wearers arm. Incorporated onto this glove is a twin set of velcro straps (1*d*) designed solely for digital watch attachments, these straps thread threw either side of the watch pincers, to fold back on them to form a tight clasp with the velcro reverse. On the top central face of the bottle is a water tight spring back push refill valve (4*b*), designed to house or at least accommodate either tap faucets and or sports or water bottle dimensions, allied with the dimensions of sports based collapsible refreshment packs. This refillable valve is substantially closed, but disengaged by means of a downwards pressure thereon, by means of a tap and or disposable sport aid bottle or pack, it automatically springs shut by means of a sealing mechanism, thereby providing a renewable conduit for firstly measures of water and or for restoring volumes of liquid back into a depleting bottle container, thus replenishing loss of fluid in an individual, when initiated this perforation of the bottle is the main spigot in which is poured the firstly volume of liquid. Situated at the glove end of the bottle is the straw mechanism (6*c*) this mechanism is incorporated into the moulding of the bottle itself and is in fact an actual part of said mentioned hydrate bottle, this in built protruding straw moulding is designed to eliminate any restrictions around the joint of the wrist and fore arm, so as to allow full maneuverability when in motion, it is also hollow with its exterior being ribbed so as to accommodate a tight seal for the extendable bendy straw hose pipe attachment (1*g*), which in turn allows liquids to flow directly threw it when being operated, the bendy straw element of the hose pipe ambidextrously bends right or left depending on what fore arm is the users preference, the flexible hose tube travels from the in built tube correlation to extend around the outer exterior of the hand passing through a junction pouch (10*a*), this junction pouch is a simplistic entity towards the over all mechanic, velcro sealed it positions in place with an ambidextrous theme the said mentioned hose pipe housing it within its hollow sleeve, this simple device eliminates the hose pipe from any unruly flopping of it own accord when running, so as a person need not continuously grip said item but can in fact vigorously shake arms and splay the carpel, metacarpal and phalanges of the hand and fingers if in the event of cramp. The hose pipe is integrally linked to a mouth valve thus ending up clenched in the palm and thumb. This hose and mouth valve consequently prevents any accidental displacement of said water. The flexible plastic hose tube coupled with mouth valve attachment inshore liquid is obtained by engaging mentioned mouth valve by applying the correct dynamic thereon e.g. in the case of the bite valve (1*h*), when a lateral pressure is employed i.e. biting. My overall hydrate systems design can and will accommodate the entire existing bite valve ranges and any other contemporised equivalents. My own valve systems are as follows the internally enclosed sport cap valve (13*a*), the externally correlated sport cap valve (13*b*) my rubber bite valve variant (13*c*) and the hard plastic latticed gate mouth valve with wheel opening key (13*d*). All of these systems in turn releases a regulated supply of liquid, thus a person is equipped to drink directly from the vessel by means of the said above theme. The internally enclosed sport cap valve (13*a*) works on the principles of a sports cap but this particular variant has no screw thread element but what it uses instead is tension to secure a tight bond within hose pipe. It has a grip circumference which has a hollow stem section that is rippled on the outside and inserts itself into the smaller radius of the plastic hose pipe tube, which then in turn is held in place with tension. The externally correlated sport cap valve (13*b*) is exactly the same as the internal version but holds its tension externally instead thereon hose pipe. This sports cap variant has as mentioned the plastic hose pipe tube inserting itself into a hollow bulbous bottom, this bulbous portion is rippled on the inside then continues upwardly by means of a hollow stem shaft that is thinner at the bulbous end then enlarges in a tubular gradient and ends at the sports cap section itself, this is designed thus, to deny any further penetration of the plastic hose pipe into the stem as this bulbous section of the variant is similar in diameter to hose pipe. This hose pipe is then in turn housed in place by means of this ergonomically determining shape plus tension. Externally this sports cap version also has a grip circumference that allows for easier detachment. Both of these editions are sufficiently different in form to that of the popular screw bottle variety. My rubber bite valve variant (13*c*) is designed in function to have a series of minute parallel puncture through-slits, these perforations are all housed within the entirety of the circular perimeter of my bite valve. Its application is not dissimilar to that of an infants bottle, the inner liquid is released in a similar fashion when lateral pressure is applied thereon. While the rubber bite valves that already exist on the market at present consist of an enlarged single slit opening for engagement of liquid, these items differ mostly in there apparel, but equally my over all utility hydration unit, will be able to accommodate and be user friendly towards already existing rubber head bite valve systems regardless. The hard plastic latticed gate mouth valve with wheel opening key (13*d*), this design has either a hard plastic mouth piece, or a rubber gum shield mouth piece. The top mouth section is design to be an ergonomically determined elliptical shape it is made of rubber or hard plastic so as to fits in front of a person's teeth and gums, and is proportioned thusly. The hard plastic hollow valve section is designed to house three parallel through compartments of latticed gates. These gates in turn hold the liquid in place by surface tension, until engaged. The wheel section has an even smaller exit hole that is minutely latticed. So if you want to deactivate device and stop the flow of liquid all you need do is turn the wheel lip accordingly, which is located on the external face of the valve wheel, this device is similar to a parmesan cheese container, but is unique in its usage as a sleuth gate for liquids. The remainder of the design is similar to my external sports cap variant. With all of these variants one could satisfactorily swig a sip of liquid virtually every other yard, while uninhibited a person could achieve continuity of motion due to the elegance of this anatomized stream line product, it plays no undue hindrance in performance its design has been thoroughly realised, to be ergonomically sound towards the requirements of the human anatomy while one is in motion. Any one of these valves can affix easily upon the hollow tubular resilient flexible plastic hose pipe with bendy straw dynamic, which in turn connects to the main body of the bottle via the hollow built in tube element of the main moulded water bottle, this device prevent liquid from freely flowing out of, unless mouth valve is engaged e.g. in the example of the bite valves with a minimal lateral appliance of pressure i.e. biting. These mouth valves dictate the flow of liquid and only release the content of the vessel when the correct procedure is dually applied. The mouth valve has an accompanying aid correlated for housing, this housing pouch (9*b*) this is a simplistic housing devise brought into play only when user has finished activity e.g. running, but is still wearing present invention, possibly walking towards car and would like to immobilise hydration system fully so as to have fullest maneuverability in independence with ones hands. Illustration (5*a*, 5*b*) pictorially combined show an athlete in full usage of the hydration system, for illustrative purposes only. The exterior surface of the bottle (3*c*) at first seems redundant of function but in fact can serve a notable purpose; commercial visuals e.g. company logo orientation can be placed here, any image will be greatly increased in size as a result of this eye level spacious location. Were as other sports ranges, example training shoes usually would go unnoticed in this field when in usage. Why this could be a major plus is if professional athletes were to adopt this eye level eye catching item, then a T.V. audience would immediately notice a commercial brand. In situations where one is jogging, there may indubitably arise the possibility of an injury or accident, so the hydrate system is suffixed with a translucent sleeve (9*a*) for displaying a mini printed foldable booklet that is held together with magnetic faces back and front, this booklet will deem important personal and medical information in cases of emergency. Aesthetics play an important part in any product (2*d*) but this can have a function too, what is being suggested is, other than an just an elaborate moulding process (4*c*) is an industrious means of gauging an anatomical correctness in measurement of volume of bottle pertaining towards liquid that this container could optimally hold without compromising performance of user. A person will have to carry this volume of water in a stable and comfortable manner while practicing a sport, e.g. running. Present invention has been designed to be ergonomically sound, aesthetically appealing while weight ratio friendly. It is also following the present trend of hands free devices e.g. Bluetooth headset, but in this case it heads the scope of hydrate systems to create a novel appliance, it is also contour friendly which accommodates the needs of the human anatomy for greater convenience with greater control for consummate mobility, speed and grace. Importantly the design has utilised the manufacturing standard quantity of 500 ml, this capacity of 500 ml has been determined by myself, as comparably shaped condiment such as shampoo bottles range at this estimate, coincide this with average lengths of both the male and female radius plus ulna bones being around 220 mm, then with the simple equation for cylinders $v=\pi r^2 \times h$, an evaluation in volume can be reached of 977, divide this number by 2 to create the volume for a semi circular cylinder and the figure reached is 488 ml, so if you then take into account the above stated aesthetic and the multitude of variables possible when moulding such an item, again you not only mould this container to be visually pleasing, you also in the same process create a very practical means of increasing the capacity, so for arguments sake by just adding upwardly facing ridges with themed shapes, this can then in turn creates any extra volume necessary towards this vessel. Also the rigidity of this cantina stably holds a volume of liquid while in turn limiting, if not preventing any drag caused by the inertia of inefficient sloshing, but even if any self propelled movement of liquid did occur, with the bottle being lateral to an individuals arm, it could be construed to be adventitious, as it could act as a forward propelling leverage pendulum. The individual can cargo this copious volume of water with stability while practicing a sporting activity with ease, as 500 ml is a coalescent measurement of liquid, as it is customary for leading manufactures to produce this volume commercially couple this with the miniscule weight of 543 grams which is the weight ratio of 500 ml, then compare this volume situated on the extremities of the arm with the same housed volume in hand held systems and equivalent strapping systems, then what this reiterates is user friendly ergonomics instilling simplicity, functionality, theme and a balance of correctness that gives to the consumer a rather more pleasant experience. The measurement only need be halved when considering the child's version as 250 ml is yet another manufacturing standard, whilst the weight ratio is only 170. The reason why my hydrate bottle replicates these manufacturing standard volumes is simply as a means of convenience, there is no economical reason to have both measurements out of sync with each other, as whilst running you can deploy the entire content of liquid from a sports drinks bottle then discard it there and then as a result of this synchronization of volumes, other that that the liquid capacity in volume could increase no end. The utility hydration system is firstly a condiment for liquid substance, but in a secondary function it can ergonomically utilise any of its unused surface space by having incorporated onto itself a multitude of useful storage facilities located mostly on the main support strap (16,19,20,21,22,23,24,25,26,27,28,30*b*,31*b*,36*c*). These storage pouches, side bags, elastic mesh bags, hook with loop attachment plus sleeves etc. can for instance harness a simple rudimentary first aid kit consisting of i.e. plasters, Vaseline sticks etc. or even nutritional energy bars. As in situations were one is running in a long distance competitive race other competitors discarded water bottles, when stepped on, could inevitably cause an individual to slip or even fall, resulting in a collision with an on coming runner, with the follow-on effect, of a possible pile up as more runners approach, consequential in unnecessary injuries. The gusseted side bag could be a possible home for housing such things as energy bars and performance health snacks i.e. raisins. Extra feature to consider towards this embodiment idea is the option of the side bags being detachable from the main support strap through the medium of Velcro (16). Combinations of elastic mesh bag plus strap bags etc show the versatility of the over all design in not limiting itself into just one optimal design but to market itself as a family of marketable embodiments. These extras as to speak demonstrate and derive from the idea that storage facilities would greatly extend the usage of this hydrate system within the scope of recreation. Coupled to this idea of variant embodiments present invention can also demonstrate several ranges of assemblage towards a strapping solutions, these additional embodiments (14,15,17,18,19,20,21,22,23,24,25,30*a*,30*b*) with just a slight modification, takes the essence of the main support strap theme (18), and considers an additional adjustable smaller Velcro support belt. That is permanently fastened to arm support strap at one end with stitching while the strip of the belt that is releasable of the external surface of the support strap can then loop back on itself, and fasten impermanent to outer external, such as by the use of hook loop and Velcro. All of these embodiments are quintessentially the same representation but are amalgamated in combination to the plethora of variety in the field of scope with the already above mentioned family of storage embodiments. Two other of my embodiments that give the market place an extra alternative towards function and or apparel are the arm sock (8*a*) and mitten (8*b*) variants, that simply would provide the consumer with warmth. The utility arm pouch (29*a*) is based on an actual kangaroo pouch, there are four of these pouches in all for protecting articles, one is positioned on your bicep (29*h*,29*l*), while another pocket locates itself on your triceps (29*f*), the remaining two on either side form a mirror image of each other, and these pouches alternate from outer humorous to inner humorous of the arm, this is in keeping with the ambidextrous nature of this product, also there are a series of loop and hook attachments for clip-on accessories such as speedometers (29*l*). These pouches perform to the universal dimensions of any mobile product, plus have strategically positioned pock-holes for ear phone sockets (29*g*). This item can either be an accessory that is independent of the main body or even laced into the fabric of the back support strap, as this utility section can be fashioned to pull in on itself and be housed inside main support strap when not in its particular usage (32), to then form a hollow cylindrical self housing tube bag, while the support strap can still be secured to the fore arm and used as a running aid regardless, as a consequence the utility support strap by principle makes the bond with the main support strap even more secure as regards the adhere towards the fore arm. It can do this and remain comfortable for several reasons, one it is stitched fully around the perimeter of the back of the main support strap, and by pulling inwardly on itself to form this self housing bag, it can evenly displace itself around the inner space of the fore arm and main support strap, but this variant only applies if the strap used is the unitary support strap (14), but even more beneficial in relation to general comfort, there are no zippered sections nor velcro etc. The elimination of zips etc. is due to the fact that all openings on these pouches consist of an elasticized mouth flange (29*a*). These elasticized mouth sections then in turn form a stead fast envelope around any personalized hand held mobile devises (29*k*). This utility storage pouch can also be manufactured to be a separate accessory worn in an alternate manner opposite of hydration system or even in a separate unrelated pursuit other than that of hydration. It is a clever way to house mobile phones, iPods, MP3 players, keys, pepper spray, speedometer, plasters, energy foods etc. in fact all manner of equipment can be lodged within arm pouch. The utility pouch serves to maintain all manner of mobile devices; the elastic flange forms a complete closed seal of the mouth of the pouch (29*c*). The utility storage system can be folded back on itself to be housed within fore arm strap, as stated, when converted into the self housing hollow tubular bag, the four pouches reverse inwardly to rest against a person's bare arm, as this is a equal displacement, these pouches then serve the secondary purpose of a couching aid. Especially provided couching foam supports could be provided as part of the initial box packaging. For example it can be envisioned that there be provided especially pre packed foam pads, in its original packaging that not only add towards the initial flash of the product but doubles up as a cushioning aid once the box has been opened. Having stated this, the utility pouch system can more than likely be independent of the main hydrate system and seen as a separate accompaniment, as professional athletes would solely be interested with hydrate aspects, were as recreational joggers would enjoy the pouch element more. The utility storage unit is in fact a modified muscle support and as thus will consist of the already tried and tested materials. The triceps portion of the pouch system could in fact be set aside, as shows in phantom (29*f*), uncovering an inner pocket solely for housing a small writing pad with loop pockets for small writing instrument, and or for accommodating bank cards therein. Yet more versatility is shown as regards economy of space with extra possibilities for efficient usage of space thereon storage units with such adornments as extra loop and hook attachments to exterior of the pouch bags (29*d*, 29*l*). The utility storage pouch flexor strap hydration system (30*a*) this system is a true amalgamation of both systems, it performs to all of the already mentioned objectives but adopts the utility storage pouch flexor section as the hydrate bottles main fore arm support. It can also be folded within itself as already stated. The utility storage pouch flexor strap hydration system, with Velcro wing strapping plus external bags (31*b*) this is exactly the same as the utility storage pouch flexor strap, but it has a Velcro strap that loops around flexor portion of the storage pouch and is held in place with Velcro to give an even sturdier bond. The wing bags are designed to be right side up when strapped and in use on the fore arm, but when independent of bond one bag appears to be upside down. These two wing bags are designated mostly for housing energy bars. A diagrammatic illustration of an athlete (33*c*) clarifies the ambidextrous qualities of present invention, as left side (33*a*) mirrors right side (33*b*) proportionally. The thermal slide bottle housed within zip pouch bag (35*a*), this system is designed for day trips and or hill walking, not only does it provide a hot drink e.g. tea or even soup; but as it is strapped to the extremities of the wrist it also acts as a heat source to the body as not only does it rest on a number of important arteries so as to insolate the inner body core through circulation, you can also rap ones arms around ones torso etc and in turn fully thermo regulated ones person. Its mechanism has a removable slide flask thermal insulated bottle (35*g*) that slides over arm rail (35*h*) section and is held in place thusly with guide rails, as this particular variant would contains tea or hot soup, this is the very reason why it is removable so as to be able to clean hygienically. The material form of this feature consists of all the appropriately correct water repellent materials, this zip bag has a hood at the front with a Velcro flap with a centralized hole (35*d*) which is fastened over the mouth of zip bag pouch (35*a*) with a Velcro strip reverse which extends around rim of main body thereby providing a secure enclosure for slide flask (35*g*) against any hazards or debris. The insolating Velcro hood (35*b*), which is the continuation lip of the central zip bag material that is folded over itself to then cover the hollow of the zip bag were the refill valve is located (35*c*) this allows ones self to thermally insolate slide bottle and still be able to refill at your own behest, this zip bag in its entirety acts just like a tea cosy. There is also an ambidextrous mitten (35*e*) this provides extra warmth. Another itinerary item of this variant is the insolating tube bag (35*f*) that houses the hose pipe and mouth valve with its lip tube bag opening at mouth valve end plus the other illustrations show the hose pipe and mouth valve independent of the insulation tube. It also sports a series of side bags, pouches, pockets hooks and loops with mesh bags etc. which are width wisely towards wearer who in turn is not compromised in any significant way when storage units are loaded. Flask bottle (35*g*) interior is made from the already tried and tested conductive thermally insulated material for gauging temperature gradients but has a plastic casing shell, this embodiment has the added advantage of conducting heat to ones person, this could be extremely applicable for hill walkers and campers. To reiterate the cut away section of the slide bottle (35*g*) illustrates the flask bottles mechanical apparatus and relationship as regards its appliance and vicinity. The zip bag can also accommodate the utility pouch system also (36*b*), possibilities of yet more storage units can apply here also (36*c*) in the form of loop and hook attachment for hooking for instance a speedometer thereon. The gel strap system (37) this is a related embodiment, as with slight modification to the bottle, by this I mean seal the container completely, you could implant a highly viscous non-toxic reusable heat gel, which is ideal for bruising. The gel strap pouch system (38) this is yet another related embodiment it is designed to house the polyethene packs (38*b*) of commercial brands of non-toxic reusable heat gels available. The handle clamp with universal shower head (39) this is a bye product it is designed to cool down an athlete when over heated it can be administrated by a coach or trainer its application is best served in the sphere of training, it is designed to make use of the commercial brands of polyethene water pouch bags. The universal shower head plus bottle (40) this is another bye product it is designed to cool down an athlete when over heated it can be administrated by a coach or trainer its application is best served in the sphere of training. But it can universally hold a bond with commercial brands of water bottles (40*c*) but regardless to this it has its own squeezable rubber bottle accessory (40*b*). The following statements are not the claims but concerns various embodiments of the invention:

First Statement

A utility refillable hydration bottle with an integral flexible hose pipe and mouth valve, contoured to anatomically conform to the forearm flexors, wrist and hand by means of a glove, cushioning panel material and arm strap so as to secure a ergonomic union of anatomy with the utility hydration system, integrally designed so as to combat dehydration without compromise.

Brake down of First statement:—a) a liquid vessel; (b) a strapping solution compatible for fore arm, wrist and hand in relation to vessel; (c) a fore arm cushioning solution; (d) a conduit from liquid chamber to mouth (e) a refill mechanism solution. This present invention configured then creates a means of constant hydration in the form of the utility hydration system.

Second Dependant Statement

The apparatus as described in statement 1; (mouth valve) internally fitted sport cap valve; this is a sports cap that fits itself on the inside of the flexible hose pipe, while held in place with tension.

Third Dependant Statement

The apparatus as described in statement 1; (mouth valve) externally sport cap valve; this is a sports cap that fits itself around the flexible hose pipe tube with in tern is inserted inwardly.

Fourth Dependent Statement

The apparatus as described in statement 1; (mouth valve) rubber bite valve variance; my design in its function has a series of minute parallel puncture holes all housed within the entirety of the circular perimeter of my bite valve.

Fifth Dependant Statement

The apparatus as described in statement 1; (mouth valve) hard plastic latticed gate mouth valve with wheel opening keys either with hard plastic mouth piece, or rubber head mouth piece; The top mouth section is designed to be a ergonomically determined elliptical shape, it is made of rubber or hard plastic so as to fit in front of a person's teeth and gums, and is proportioned thusly. The hollow stem section is designed to house parallel through compartments of latticed gates. These gates in turn hold the liquid in place by surface tension, until engaged. The wheel section has an exit that is minutely latticed.

Independent Statement 1

The apparatus as described in statement 1, combined with the utility storage pouch system; this storage facility deployed ergonomically to ones biceps, triceps and humorous elevates the burden of cargo. This item refers to the remaining aspects of mobile pursuits e.g. the storage of mobile phones music entertainment devices, and other related paraphernalia such as speedometers etc. Its can either be a separate item or it can even be attached to the hydrate bottle with a secure bond and perform the dual duties of storage and be the means of the main flexor strap.

Independent Statement 2

The thermal bottle housed with pouch bag plus mitten and arm sock; this system is designed for recreational day trips and or hill walking, not only does it provide a hot drink e.g. tea or even soup; but as it is strapped to the extremities of the wrist it also acts as a heat source to the body as not only does it rest on a number of important arteries so as to insolate the inner body core through circulation, you can also rap ones arms around ones torso etc and in turn fully thermo regulate ones person.

Independent Statement 3

The apparatus as described in statement 1 plus independent statement 2; the gel strap system; this is a related embodiment, as with slight modification to present invention you could implant a highly viscous non-toxic reusable heat gel, which is ideal for bruising and injury recuperation.

Independent Statement 4

The squeeze bottle handle clamp with universal shower head; this is a bye product it is designed to cool down an athlete when over heated it can be administrated by a coach or trainer its application is best served in the sphere of training.

Independent Statement 5

The apparatus as described in statement 1; considering the multitude of variant embodiment possibilities of storage units strapping solutions, visual and instructive information sleeves plus several mouth valve responses that I have described as to answer any questions towards what ranges already exists. This present invention plus its embodiments reiterates ergonomic efficiency. But as for questions that may arise from considering other solutions towards rethinking aspects of this design that could be readdress by those skilled in the fields of scope then it could only be construed that all if any fair modifications brought about by those skilled in these arts e.g. development of individual elements, then these modifications brought about should be deemed to be in all fairness just an encompassment of my original scope of realisation.

Statement 1A

A utility refillable hydration flexible hose pipe bite valve bottle contoured to anatomically position itself thereon forearm flexors wrist and hands by means of an ambidextrous glove, cushioning panel material and main strap support, with the main target group being that of a sports enthusiast, integrally designed so as to combat dehydration.

Statement 2A

The apparatus as described in statement 1A, with an optional utility storage arm pouch positioned on biceps and triceps for carrying personal and specialist effects.

Statement 3A

The apparatus as described in statement 1A, with optional pouch bags located on either side of main support strap with mesh bag facilities draped thereon contoured hydrate bottle.

Statement 4A

The apparatus as described in statement 1A, with an optional adjustable velcro hoot and loop strap sewn thereon underside of main support strap.

Statement 5A

The apparatus as described in statement 1A, with a translucent sleeve located upon underside of main support strap.

Statement 6A

The apparatus of statement 1A modified, in the guise of a recreational variant; a zip pouch bag housing a removable slide rail thermal flask.

Statement 7A

The apparatus as described in statement 6A, without zip bag variant.

Statement 8A

The apparatus as described in statement 1A, modified, by the means of completely sealed vessel housing non toxic reusable gel used for injury recuperation.

Statement 1B

The apparatus may utilize a honeycombed material, housed inside the vessel, to alleviate or combat sloshing motion whilst in use.

Other variants will no doubt occur to those skilled in the art upon the study of the detailed description and drawings contained herein. Accordingly, it is to be understood that the present invention is not limited to the specific embodiments descried herein, but should be deemed to extend to the subject matter defined by the appended claims, including all fair equivalents thereof. Any minor modifications to the present invention which do not deviate from the themed scope thereof are considered to be therein included. While a preferred embodiment of invention has been disclosed, various modes of carrying out principles disclosed herein are contemplated as being within the scope of the following claims. Therefore it is understood that the scope of the invention is not to be limited except as otherwise set forth in claims. While the foregoing embodiments are well suited to achieve the above stated objects, those skilled in the art to which the present invention pertains, should realise that such embodiments are subject to modification, alteration and change without departing from the scope and spirit of the present invention.

The invention claimed is:

1. A liquid dispensing apparatus securable to the arm of a user, comprising a liquid vessel having a chamber for receiving and storing liquid, a liquid conduit having a first end in liquid communication with the chamber and a second end connected to a conduit valve for controlling the flow of liquid through the conduit, and at least two fastening members for securing the apparatus to an arm of a user, the first member comprising a glove support for coupling to at least a portion of the user's hand and a second member for coupling to the user's fore-arm, wherein the glove support comprises at least one aperture through which the thumb of a user can extend.

2. An apparatus as claimed in claim 1 wherein the second fastening member also extends from the forearm beyond the elbow of a user such that the apparatus is also coupled to the upper arm of a user.

3. An apparatus as claimed in claim 1, wherein the valve comprises a bite-operated valve to open and close the valve to permit and prevent respectively the flow of liquid from the chamber through the conduit and out of the valve.

4. An apparatus as claimed in claim 1, wherein the valve is hand operated to open and close to permit and prevent respectively the flow of liquid from the chamber through the conduit and out of the valve.

5. An apparatus as claimed in claim 1 wherein the glove support comprises two apertures for receiving the thumb of a user, the apertures disposed diametrically opposite one another such that the apparatus can be worn on a user's left or right arm.

6. An apparatus as claimed in claim 1, wherein the glove support extends over a user's fingers.

7. An apparatus as claimed in claim 1, further comprising a storage pocket.

8. An apparatus as claimed in claim 7 wherein the storage pocket is disposed on one or more of the fastening members.

9. An apparatus as claimed in claim 1, wherein the liquid vessel further comprises a re-fill valve for allowing liquid to be introduced into the chamber.

10. An apparatus as claimed in claim 9 wherein the re-fill valve is one way valve.

11. An apparatus as claimed in claim 9, wherein the re-fill valve is biased into a closed position whereby an actuator can be displaced to open the valve and allow liquid to pass therethrough.

12. An apparatus as claimed in claim 1, wherein the liquid conduit is tubular.

13. An apparatus as claimed in claim 1, wherein the first and second fastening members are integrally formed with one another.

14. An apparatus as claimed in claim 1 wherein the second fastening member comprises a strap having two releasably securable end portions.

15. An apparatus as claimed in claim 14 wherein the two releasably securable ends each comprises one member of a mating pair.

16. An apparatus as claimed in claim 15 wherein the mating pair comprises hook and loop mating means.

17. An apparatus as claimed in claim 1, wherein the second fastening member comprises a closed loop strap.

18. An apparatus as claimed in claim 1, wherein the liquid conduit and is contoured so as to be held in the hand during use.

19. An apparatus as claimed in claim 18 wherein the glove support comprises means to store the liquid conduit and conduit valve when not in use.

20. An apparatus as claimed in claim 1, wherein the conduit valve is a bite-valve, openable by a user biting said valve.

21. An apparatus as claimed in claim 1, wherein the conduit valve is openable and closable by displacing an actuator.

22. An apparatus as claimed in claim 1, wherein the conduit valve comprises a valve opening and is shaped to conform to the contours of a user's gum.

23. An apparatus as claimed in claim 1, wherein the conduit comprises a flexible hose.

24. An apparatus as claimed in claim 1, wherein the liquid vessel is releasably mounted on the apparatus.

25. An apparatus as claimed in claim 24 wherein the liquid vessel is releasably mounted on the apparatus.

26. An apparatus as claimed in claim 1, wherein the liquid vessel is formed from a flexible membrane.

27. An apparatus as claimed in claim 1, wherein the liquid vessel is insulated so as to substantially maintain the temperature of a liquid introduced into said liquid vessel for a period of time.

28. An apparatus as claimed in claim 1, wherein the glove support comprises an integrally formed hand warming device.

29. A kit of parts comprising an apparatus as claimed in claim 1, and a liquid delivery means for assisting in the introduction of liquid into the liquid vessel.

* * * * *